United States Patent [19]

Matsuoka et al.

[11] Patent Number: 4,973,367

[45] Date of Patent: Nov. 27, 1990

[54] METHOD OF MANUFACTURING STEEL SHEET HAVING EXCELLENT DEEP-DRAWABILITY

[75] Inventors: Saiji Matsuoka, China; Susumu Satoh, Chiba; Toshiyuki Katoh, Chiba; Hideo Abe, Chiba; Ikuo Yarita, Chiba, all of Japan

[73] Assignee: Kawasaki Steel Corporation, Kobe, Japan

[21] Appl. No.: 454,923

[22] Filed: Dec. 22, 1989

[30] Foreign Application Priority Data

| | | | |
|---|---|---|---|
| Dec. 28, 1988 | [JP] | Japan | 63-329217 |
| Feb. 20, 1989 | [JP] | Japan | 1-38376 |
| Mar. 9, 1989 | [JP] | Japan | 1-55048 |
| Apr. 19, 1989 | [JP] | Japan | 1-97284 |
| Oct. 27, 1989 | [JP] | Japan | 1-278655 |

[51] Int. Cl.[5] ..... C21D 8/04

[52] U.S. Cl. ..... 148/12 C; 148/12 F

[58] Field of Search ..... 148/12 C, 12 F

[56] References Cited

FOREIGN PATENT DOCUMENTS

| | | | |
|---|---|---|---|
| 52-71362 | 6/1977 | Japan | 148/12 C |
| 58-107414 | 6/1983 | Japan | 148/12 C |
| 59-74232 | 4/1984 | Japan | 148/12 C |
| 60-50120 | 3/1985 | Japan | 148/12 C |
| 61-130423 | 6/1986 | Japan | 148/12 C |

*Primary Examiner*—Deborah Yee

*Attorney, Agent, or Firm*—Dvorak and Traub

[57] ABSTRACT

A method of manufacturing a steel sheet having excellent deep-drawability. A steel blank is rolled into a steel sheet having a predetermined thickness. The steel contains C: not more than 0.008 wt %, Si: not more than 0.5 wt %, Mn: not more than 1.0 wt %, P: not more than 0.15 wt %, S: not more than 0.02 wt %, Al: 0.010 to 0.10 wt %, N: not more than 0.008 wt %, and at least one element selected from the group consisting of Ti and Nb which is contained in an amount satisfying the relationship of $1.2\ (C/12+N/14) \leqq (Ti/48+Nb/93)$. In at least one pass, rolling is conducted within a temperatures range lower than the Ar3 transformation point but not lower than 500° C., in such a manner that the roll radius R (mm) and the blank thickness t (mm) before rolling by rolls satisfy the relationships of $R \leqq 200$ and $R^2 \times \sqrt{t} \leqq 100000$, and the total rolling reduction at temperature lower than the Ar3 transformation point is not lower than 60%. The hot-rolled steel sheet possesses a high level of Lankford value, and is free from cold-working embrittlement. The method may include the step of obtaining, after the rolling, pickling, annealing and hot dip galvanizing under certain conditions, a surface-treated steel sheet having excellent deep-drawability.

20 Claims, 1 Drawing Sheet

METHOD OF MANUFACTURING STEEL SHEET HAVING EXCELLENT DEEP-DRAWABILITY

BACKGROUND OF THE INVENTION

1. Field of the Invention

The present invention relates to a method of manufacturing steel sheets having excellent deep-drawability which sheets may be suitably used in manufacturing automobile bodies. Specifically, the present invention relates to a method of manufacturing hot-rolled steel sheets having excellent deep-drawability, as well as to a method of manufacturing surface-treated steel sheets.

2. Description of the Background Art

When steel sheets are prepared for deep drawing so that they may be used in manufacturing automobile bodies, they are required to have high Lankford values (r-values) and a high ductility (El: Elongation value). Such a steel sheet has generally been prepared as cold-rolled steel sheet manufactured by effecting hot rolling which is terminated at temperatures not lower than the Ar3 transformation point, subsequently obtaining the final thickness by cold rolling, and thereafter effecting recrystallization annealing. In recent years, however, in view of reducing production costs, there have been increasing demands for the substitution of members, which have hitherto been formed of cold-rolled steel sheet, with those formed of hot-rolled steel sheet.

In regard to hot-rolled steel sheet for use in working, it has hitherto been prepared in such a manner that, in order to assure satisfactory working properties, in particular ductility, rolling is terminated at temperatures not lower than the Ar3 transformation point so as to avoid formation of nonrecrystallized ferrite. However, since random orientation usually occurs in the texture during the $\gamma$ to $\alpha$ transformation, a hot-rolled steel sheet has considerably poor deep-drawability when compared with cold-rolled steel sheet. Hitherto, the r-value of hot-rolled steel sheet has ranged from 0.8 to 0.9 at most.

Recently, however, several methods of obtaining hot-rolled steel sheet excellent in deep-drawability have been proposed, in which no cold rolling is required. For instance, Japanese Pat. Laid-Open No. 226149/1984 discloses an example of a hot-rolled steel sheet having an r-value of 1.21 which is manufactured by subjecting low-carbon Al killed steel containing C: 0.002%, Si: 0.02%, Mn: 0.23%, P: 0.009%, S: 0.008%, Al: 0.025%, N: 0 0021%, and Ti: 0.10% to rolling at a reduction of 76% and at temperatures ranging from 500° to 900° C. while a lubricant is supplied, so as to obtain a steel strip having a thickness of 1.6 mm. In this method, however, because strong lubricated rolling must be effected during hot rolling, this inevitably involves some operational problems such as the risk of slipping occurring in the steel blank during rolling. Japanese Patent Laid-Open No. 192539/1987 discloses an example of a hot-rolled steel sheet having an r-value of 1.41 which is manufactured by subjecting low-carbon Al killed steel containing C: 0.008%, Si: 0.04%, Mn: 1.53%, P: 0.015%, S: 0.004%, Ti: 0.068%, and Nb: 0.024% to rolling at a reduction of 92% and at temperatures ranging from the Ar3 transformation point to the Ar3 transformation point +150° C. In this method, however, because hot rolling is terminated at a temperature within the $\gamma$-phase range, and the transformed tissue resulting from the subsequent $\gamma$ to $\alpha$ transformation is utilized, this inevitably has a preferred orientation of {112}. As a result, the value of $\Delta r$ that is indicative of planer anisotropy of the r-value becomes so great that $\Delta r = -1.2$. This is detrimental in practice.

In order to insure excellent deep-drawability, a method must achieve the relationship of $r \geqq 1.4$ at least, without involving operational problems in conducting hot rolling, and without causing anisotropy.

In regard to a steel sheet which is prepared for use in manufacturing automobile bodies, there have recently been increasing demands for a surface-treated steel sheet having surfaces which have been subjected to various kinds of surface treatments. Among various types of surface-treated steel sheets, one of the more superior is the hot dip galvanized sheet because this is advantageous in both production cost and its properties.

A hot dip galvanized steel sheet is required to possess various properties. One of the most important requirements is excellent corrosion resistance, while deep-drawability is another important requirement. Since outside or inside panels of automobiles are usually formed by strong press working, it must be prepared as a galvanized sheet which possesses both a high Lankford value (r-value) and a high level of elongation.

A method of manufacturing such a galvanized sheet possessing excellent deep-drawability is disclosed in, for instance, Japanese Patent Laid-Open No. 29555/1982. This patent publication proposes the art of attaining properties of the order of r=2.0 and El=49% by subjecting a steel containing C: 0.006 wt % ("wt %" will hereinafter be abbreviated to "%"), N: 0.0045%, Si: 0.008%, and Nb: 0.043% to hot rolling, pickling and cold rolling, and further subjecting the steel to recrystallization annealing and plating in a continuous galvanizing line. Japanese Patent Laid-Open No. 74231/1984 discloses the art of attaining properties of the order of r=2.1 and El=51% by subjecting a steel containing C: 0.003%, N: 0.005%, Si: 0.010%, Ti: 0.012%, and Nb: 0.007% to hot rolling, pickling and cold rolling, and further subjecting the steel to recrystallization annealing and plating in a continuous galvanizing line.

Although each of these methods is successful in manufacturing a galvanized sheet possessing excellent deep-drawability, a long series of processes has to be conducted before the final product is obtained. This means that great amounts of energy, labor and time must be consumed in order to manufacture such galvanized sheet.

SUMMARY OF THE INVENTION

According to the present invention, the chemical composition of blank steel, as well as the rolling conditions, in particular, certain conditions during the final rolling, i.e., the roll radius, the initial thickness of the blank and the coefficient of friction therebetween, are suitably controlled.

An object of the present invention is to provide a method of obtaining a steel sheet suitable for use in deep drawing which possesses a high Lankford value (r-value) satisfying the relationship of $r \geqq 1.4$ as hot rolled.

Another object of the present invention to provide a method of obtaining a steel sheet suitable for use in deep drawing which does not suffer from cold-working embrittlement.

Still another object of the present invention is to provide a method of obtaining a surface-treated steel sheet having excellent deep-drawability.

BRIEF DESCRIPTION OF THE DRAWINGS

FIG. 2 is a graph used to explain the influence on the r-value by $R^2 \times \sqrt{t}$ (t being the thickness before rolling);

FIG. 3 is a graph used to explain the influence on the r-value by $t/R^4$;

FIG. 4 is a graph used to explain the influence on the r-value by the coefficient of friction $\mu$; and FIG. 5 is a graph used to explain the influence on the r-value by log(R/t).

DESCRIPTION OF THE PREFERRED EMBODIMENTS

Figure 1:
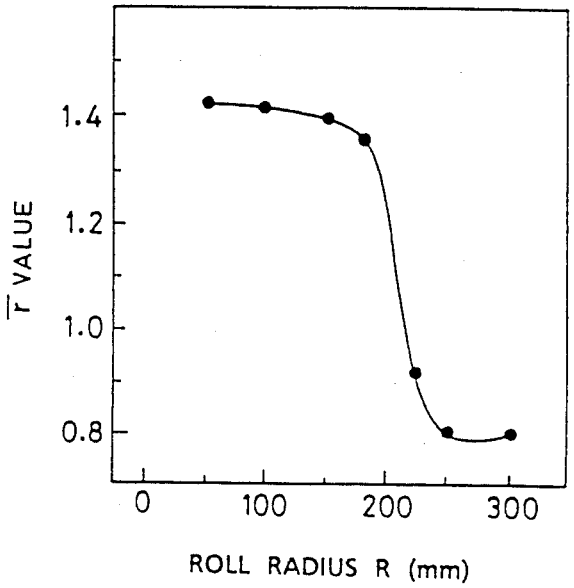
FIG. 1 is a graph used to explain the influence on the r-value by the roll radius R.

Explanations will first be given of the results of studies and experiments conducted by the present inventor on the basis of which the rolling conditions and the chemical composition of the steels used are specified according to the present invention.

a. Conditions of Rolling within a Temperature Range Lower than the Ar3 Transformation Point (1) Relationship between roll radius or blank thickness with the r-value:

According to the present invention, the roll radius R (mm), i.e., the radius of rolls of the rolling mill used, as well as the initial thickness t (mm), i.e., the thickness of a steel blank before rolling, must satisfy the relationship of $R \leqq 200$ and the relationship of $R^2 \times \sqrt{t} \leqq 100000$.

In a series of experiments, a hot-rolled blank having the chemical composition including C: 0.002%, Si: 0.01%, Mn: 0.1%, P: 0.012%, S: 0.012%, N: 0.002%, Ti: 0.04%, and Nb: 0.010% was heated and soaked at 700° C., rolled at a reduction of 60% in one pass, and continuously subjected to self-annealing at 700° C. for 1 hour which was effected simultaneously with coiling. The final rolling was effected without using a lubricant. The initial thickness t was set at 1.2 mm. In these experiments, the radius R of the rolls used in the rolling was varied from 50 to 300 mm. FIG. 1 shows the thus obtained data, that is, a graph useful in understanding the influence of the r-value of the resultant hot-rolled sheet by the roll radius R. As shown in FIG. 1, the r-value changes with changes in the roll radius R. If R (mm) $\leqq 200$, the r-value is improved remarkably.

In another series of experiments, a hot-rolled blank, having the same chemical composition, was subsequently subjected to heat-soaking at 700° C., to 60%-reduction rolling in one pass, and, continuously therefrom, to coiling-simultaneous self-annealing at 700° C. for 1 hour. The final rolling was a non-lubricated rolling. In these experiments, the radius R of the rolls used was fixed at 180 mm, while the initial thickness t was varied from 1 to 20 mm. FIG. 2 is a graph useful in understanding the influence of the r-value of the resultant hot-rolled sheet by the product $R^2 \times \sqrt{t}$ determined by the roll radius R and the initial thickness t. As shown in FIG. 2, the r-value changes with changes in $R^2 \times \sqrt{t}$. If $R^2 \times \sqrt{t} \leqq 100000$, the r-value is improved remarkably.

The above-mentioned rolling conditions are specified on the basis of the following finding. If rolling is conducted within a temperature range lower than the Ar3 transformation point while employing ordinary rolling conditions (wherein R (mm) $>300$ in the case of hot rolling), force resulting from friction between the rolls and the steel being processed causes additional shearing force to act on a surface layer of the steel, as a result, the {110} orientation, which is not favorable to the achievement of high deep-drawability, is preferred in the surface layer of the steel. In this case, therefore, the resultant steel sheet possesses poor deep-drawability. In contrast, it has been determined from the experiments that, if the relationships of R (mm)$\leqq 200$ and $R^2 \times \sqrt{t} \leqq 100000$ are satisfied, it is possible to reduce the level of occurrence of the {110} orientation in the surface layer of the steel and, simultaneously, to increase the level of occurrence of the {111} orientation, which is favorable to the improvement of the r-value. For this reason, the relationships of R (mm)$\leqq 200$ and $R^2 \times \sqrt{t} \leqq 100000$ are specified as rolling conditions.

In a further series of experiments, a hot-rolled blank having the chemical composition including C: 0.002%, Si: 0.02%, Mn: 0.1%, P: 0.011%, S: 0.013%, N: 0.002%, Ti: 0.04%, and Nb: 0.013% was subjected to 60%-reduction rolling at 700° C. in one pass, and was continuously subjected to coiling-simultaneous self-annealing at 700° C. for 1 hour. The final rolling was non-lubricated rolling. In these experiments, the initial thickness t was varied between 1 and 30 mm while the radius R of the rolls used was varied between 100and 350 mm. FIG. 3 is a graph useful in understanding the influence of the r-value of the resultant hot-rolled sheet on the roll radius R and the initial thickness t. As shown in FIG. 3, the r-value changes with changes in the fraction $t/R^4$. If $t/R^4 \geqq 6 \times 10^{-10}$, the r-value is improved remarkably.

In a rolling mill having a plurality of stands, the roll radius R in rolls of the downstream stands (e.g., in the rolls of the downstream 2 stands in a 6-stand mill, or rolls of the downstream 3 stands in a 7-stand mill) may be set to satisfy R (mm)$\leqq 200$.

(2) Relationship between coefficient of friction and r-value:

The roll radius R (mm), the initial thickness t (mm) and the coefficient of friction $\mu$ should preferably satisfy the relationship of $\mu \leqq -0.2 \log(R/t) + 0.55$.

In a series of experiments, a hot-rolled blank having the chemical composition including C: 0.002%, Si: 0.02%, Mn: 0.1%, P: 0.011%, S: 0.013%, N: 0.002%, Ti: 0.04%, and Nb: 0.013% was subjected to 60%-reduction rolling at 700° C. in one pass, and it was continuously subjected to coiling-simultaneous self-annealing at 700° C. for 1 hour. In these experiments, while the radius R of the rolls used was fixed at 300 mm and the initial thickness t was fixed at 3 mm, the lubricating condition during rolling was varied in such a manner that the coefficient of friction $\mu$ varied within the range from 0.1 to 0.25. FIG. 4 is a graph useful in understanding the influence of the r-value of the resultant hot-rolled sheet by the coefficient of friction $\mu$. As shown in FIG. 4, the r-value changes with changes in the coefficient of friction $\mu$. If $m \leqq 0.15$, the r-value is improved remarkably.

Subsequently, log(R/t) was varied by changing the roll radius R and the initial thickness t, while the coefficient of friction remained fixed at 0.15. FIG. 5 is a graph useful in understanding the influence of log(R/t) on the r-value of the hot-rolled steel sheet after annealing. As shown in FIG. 5, the r-value changes with changes in log(R/t). If $\log(R/t) \leqq 2.0$, the r-value is improved remarkably.

The results of the above-described experiments have lead to the following conclusion. If rolling is conducted within a temperature range lower than the Ar3 transformation point while employing the condition expressed as $\mu > -0.2 \log(R/t) + 0.55$, a problem, similar to that described before arises, in which a force resulting from friction between the rolls and the steel being processed causes an additional shearing force to act on a surface layer of the steel. As a result, the {110} orientation, which is undesirable for deep-drawability, is not preferred in the surface layer of the steel sheet. In this case, therefore, the resultant steel sheet possesses poor deep-drawability. In contrast, it has been clarified from the experiments that if the relationship of $\mu \leqq -0.2 \log(R/t) + 0.55$ is satisfied, it is possible to reduce the level of occurrence of the {110} orientation in the surface layer of the steel and, simultaneously, to increase the level of occurrence of the {111} orientation, which is favorable to the improvement of the r-value. For this reason, the relationship of $\mu \leqq -0.2 \log(R/t) + 0.55$ should preferably be satisfied.

(3) Rolling reduction within temperature range lower than the Ar3 transformation point:

If rolling is effected within a temperature range lower than the Ar3 transformation point at a total reduction which is lower than 60%, the {111} orientation does not occur to a sufficient extent during rolling, thereby failing to achieve a high r-value. Preferably, the total rolling reduction should be equal to or higher than 70%.

(4) Summary of conditions of rolling within temperature range lower than the Ar3 transformation point:

The following can be concluded from the above-described results. The roll radius R (mm) must satisfy the relationship of $R \leqq 200$ and, simultaneously, the roll radius R and the thickness t (mm) before rolling must satisfy the relationship of $R^2 \times \sqrt{t} \leqq 100000$.

Lubricated rolling should preferably be effected. This makes it possible to achieve further improvement in deep-drawability. In addition, the surface configuration of the rolls used can be improved, and the rolling load can be reduced.

The roll radius R and the thickness t before rolling should preferably satisfy the relationship of $t/R^4 \leqq 6 \times 10^{-10}$. If rolling is effected while this condition is adopted, it is possible to reduce the level of occurrence of the {110} orientation in a surface layer of the steel and, simultaneously, to increase the level of occurrence of the {111} therein, so as to improve the r-value.

The total reduction at which rolling is effected within a temperature range lower than the Ar3 transformation point must be equal to or higher than 60%.

b. Effect of Chemical Composition

The following shows why the proportion of various components in the steel used is specified according to the present invention.

(1) Carbon

Carbon (C) should be contained in as small a proportion as possible to improve deep-drawability. If the content of C is not more than 0.008 wt %, this will not cause much adverse influence. Therefore, the content of C is limited to a proportion of not more than 0.008 wt %.

(2) Silicon

Since silicon (Si) acts to strengthen the steel, it is added in an amount to achieve a desired level of strength. However, if the content of Si exceeds 0.5 wt %, this will have adverse influence on deep-drawability. Therefore, the content of Si is limited to a proportion of not more than 0.5 wt %.

(3) Manganese

Since manganese (Mn) acts to strengthen the steel, it is added in an amount to achieve a desired level of strength. However, if the content of Mn exceeds 1.0 wt %, this will have adverse influence on deep-drawability. Therefore, the content of Mn is limited to a proportion of not more than 1.0 wt %.

(4) Phosphorus

Since phosphorus (P) acts to strengthen the steel, it is added in an amount to achive a desired level of strength. However, if the content of P exceeds 0.15 wt %, this will have adverse influence on deep-drawability. Therefore, the content of P is limited to a proportion of not more than 0.15 wt %.

(5) Sulphur

Sulphur (S) should be limited to as small a proportion as possible for improving deep-drawability. If the content of S is not more than 0.02 wt %, this will not have much adverse influence. Therefore, the content of S is limited to a proportion of not more than 0.02 wt %.

(6) Aluminum

Since aluminum (Al) acts to enable deoxidation, Al is added in accordance with necessity in order to prevent excessive consumption of carbide and nitride forming elements. However, if Al is added in an amount not more than 0.010 wt %, no favorable effect is provided by the addition of Al. On the other hand, if Al is added in an amount exceeding 0.10 wt %, no further increase occurs in the extent to which the deoxidation action is provided. Therefore, the content of Al is limited within the range from 0.010 to 0.10 wt %.

(7) Nitrogen

Nitrogen (N) should be limited to as small a proportion as possible for improving deep-drawability. If the content of N is not more than 0.008 wt %, this will not have much adverse influence. Therefore, the content of N is limited to a proportion of not more than 0.008 wt %.

(8) Titanium

Titanium (Ti) is a carbide and nitride forming element which acts to reduce the amount of solute C or N in the steel. Therefore, Ti is added in order to insure the preferred occurrence of the {111} orientation which is favorable to the improvement of deep-drawability. However, if Ti is added in an amount less than 0.01 wt %, no favorable effect is provided by such addition. On the other hand, if Ti is added in an amount exceeding 0.20 wt %, no further increase occurs in the extent to which the effect is provided, while there is a risk that the surface properties of the steel will be degraded. Therefore, the content of Ti is limited to a proportion within the range from 0.01 to 0.20 wt %.

(9) Niobium

Niobium (Nb) is a carbide forming element which acts to reduce the amount of solute C in the steel, and which is also helpful in making a fine grain before the final rolling. That is, solute Nb acts to accumulate strain applied during rolling, thereby enabling the preferred occurrence of the {111} orientation, hence, improving the deep-drawability. However, if Nb is added in an amount less than 0.001 wt %, no favorable effect is obtained. On the other hand, if Nb is added in an amount exceeding 0.040 wt %, there is a risk that the recrystallization temperature will be raised. Therefore, the content of Nb is limited to a proportion within the range from 0.001 to 0.040 wt %.

(10) Relation between carbon, nitrogen, titanium and niobium

If there is neither solute C nor solute N before the final rolling, the {111} orientation preferably occurs after the rolling and the subsequent annealing, thereby improving deep-drawability. The present inventor has found that, if carbon (C), nitrogen (N), titanium (Ti) and niobium (Nb) are added in such a manner that the relationship of $1.2\ (C/12+N/14) \leqq (Ti/48+Nb/93)$ is satisfied, in other words, the total of Ti and Nb is an amount equivalent to or greater than the total of C and N, neither solute of C nor solute of N will exist before the final rolling. It has also been determined that, in this case, the r-value is increased. For these reasons, the relation between the contents of C, N, Ti and Nb should satisfy the relationship of $1.2\ (C/12+N/14) \leqq (Ti/48+Nb/93)$.

(11) Boron

Boron (B) acts to improve resistance to cold-working embrittlement (RSWE). However, if B is added in an amount less than 0.0001 wt %, no favorable effect is obtained. On the other hand, if B is added in an amount exceeding 0.0020 wt %, there is a risk that deep-drawability will be degraded. Therefore, the content of B is limited to a proportion within the range from 0.0001 to 0.0020 wt %.

(12) Antimony

Antimony (Sb) acts to prevent nitridation during batch annealing. However, if Sb is added in an amount less than 0.001 wt %, no favorable effect is obtained. On the other hand, if Sb is added in an amount exceeding 0.020 wt %, there is a risk that deep-drawability will be degraded. Therefore, the content of Sb is limited to a proportion within the range from 0.001 to 0.020 wt %.

(13) Summary of chemical composition

The steel blank must have a chemical composition including C: not more than 0.008 wt %, Si: not more than 0.5 wt %, Mn: not more than 1.0 wt %, P: not more than 0.15 wt %, S: 0.02 wt %, Al: 0.010 to 0.10 wt %, N: not more than 0.008 wt %, and at least one selected from the group consisting of Ti and Nb which is contained in an amount satisfying the relationship of $1.2\ (C/12+N/14) \leqq (Ti/48+Nb/93)$. In order to improve resistance to cold-working embrittlement, B: 0.0001 to 0.0020 wt % should also be added. In order to prevent nitridation during batch annealing, Sb: 0.001 to 0.020 wt % should also be added. If the blank steel does not have the above-specified chemical composition, it is not possible to achieve excellent deep-drawability.

As long as the blank to be rolled has the above-specified chemical composition, it may be a slab or sheet prepared by means of a normal continuous casting system, or a sheet bar prepared by means of a sheet bar caster. With a view to saving energy, a combination of processes CC-DR in which continuous casting and hot rolling are continuously effected may be effectively adopted.

c. Hot Rolling Temperature Conditions (1) Hot rolling finish temperature and coiling temperature:

According to the present invention, in order to achieve a further improvement in deep-drawability, it is of importance that coiling or recrystallization annealing after the rolling process is effected under a certain condition in which the finish delivery temperature (FDT) in hot rolling and the coiling temperature (CT) satisfy the relationships of $(FDT)-(CT) \leqq 100°$ C. and $(CT) \geqq 600°$ C.

If the final rolling is terminated within a temperature range not lower than the Ar3 transformation point, random orientation occurs in the texture during the $\gamma$ to $\alpha$ transformation, thereby making it impossible to achieve excellent deep-drawability. On the other hand, if the finish temperature of the final rolling is lowered below 500° C., this does not lead to any further improvement in deep-drawability, while involving unnecessary increase in the rolling load. Therefore, the rolling temperature is set within a range lower than the Ar3 transformation point but not lower than 500° C.

(2) Roughening conditions and finish entrance temperature (FET) in the final rolling stage of hot strip mill:

In order to achieve a further improvement in deep-drawability, the following conditions should preferably be adopted: roughening is terminated within a temperature range which is not higher than 950° C. but which is not lower than the Ar3 transformation point, and the finish entrance temperature (FET) is set at a temperature not higher than 800° C. This is for the following reasons. If roughening is terminated within a temperature range between 950° C. and the Ar3 transformation point, both inclusive, this enables the texture before the final rolling to become fine, thereby facilitating the accumulation of strain to be applied during the final rolling. This results in the preferred occurrence of the {111} orientation, hence, improvement of deep-drawability. The rolling reduction during the roughening should preferably be equal to or higher than 50% in order to make the grain fine. If the FET is not higher than 800° C., this enables the rolling reduction within low-temperature ranges to be increased, thereby enabling an increased amount of strain to be applied during the rolling to the grains in the {111} orientation. This results in the preferred occurrence of the {111} orientation after recrystallization annealing, hence, an increase in the r-value.

(3) Self-annealing or recrystallization temperature:

In the case where the rolled sheet is not subjected to recrystallization annealing after the final rolling, and it is allowed to undergo coiling-simultaneous self-annealing, the CT is set at a temperature satisfying the relationship of $CT \geqq 600°$ C. because if the coiling temperature CT is lower than 600° C., recrystallization is not completed. In order to improve deep-drawability, it is advantageous to use a relatively low rolling temperature together with a relatively high coiling temperature. For this purpose, the rolling should be effected under the condition where the finish delivery temperature (FDT) and the coiling temperature CT satisfy the relationship of $(FDT)-(CT) \leqq 100°$ C. In the case where the rolled sheet is subjected to recrystallization annealing after the hot rolling, since no coiling-simultaneous self-annealing is necessary, while the hot rolling finish temperature FDT should not be lower than 500° C., the coiling temperature CT may be a relatively low temperature.

The recrystallization annealing method, which is adopted in the case where, after the rolling, the hot-rolled sheet is not subjected to self-annealing but is subjected to recrystallization annealing, may be either a continuous annealing method or a box annealing method. A suitable range of annealing temperature is from 550° to 950° C. The heating speed may range from 10° C./hr to 50° C./s. d. Conditions of Pickling, Annealing, & Galvanizing According to the present invention, since the hot rolling temperature is moderately low to be within the range lower than the Ar3 transformation point, scale formed on the surface of the hot-rolled sheet has a relatively small thickness which is 3 mm or smaller. Therefore, a pickling treatment may be effected by, instead of passing the hot-rolled sheet through an ordinary pickling line, using a light pickling bath provided in a galvanizing line to effect pickling as a pretreatment. If the pickling is effected by adopting a method including, in addition to an ordinary pickling process, a mechanical descaling process employing a mechanical descaling means such as shot or a leveler, improved results of pickling can be achieved. Thereafter, annealing is effected at temperatures ranging from 700° to 900° C. for 1 second to 20 minutes, and this is continuously followed by galvanizing.

If the pickling, the annealing and the galvanizing are effected continuously, the surface of the steel sheet will be in its activated state before the galvanizing, and plating adhesion will be enhanced. On the contrary, if the hot-rolled sheet is left standing for several hours after pickling, and it is then subjected to galvanizing, the plating will be more or less degraded. According to the present invention, light pickling, annealing and galvanizing may be continuously effected after the hot-rolled sheet has been passed through an ordinary pickling line.

A conventionally known method of plating an alloy or non-alloy material can be suitably used during the galvanizing.

(Example 1)

Steel sheets Nos. 1 to 3, shown in Table 2, were obtained in the following manner. Steel slabs having the chemical compositions of the types 501 and 501 shown in Table 1 were heated and soaked at 1150° C. Thereafter, the slabs were roughened, then subjected to final rolling. Table 2 shows the conditions adopted in these processes, i.e., the roughening delivery temperature (RDT), the finish delivery temperature (FDT), the rolling reduction during rolling within a temperature range lower than the Ar3 transformation point but not lower than 600° C., the coiling temperature (CT), whether any lubricant was used or not, the radius R (mm) of rolls on three downstream stands of the rolling mill used, and the values of $R^2\times\sqrt{t}$ (t being the thickness t (mm) before the final rolling). The final thickness, i.e., the thickness of the finished steel sheets was 1.2 mm. Properties of the hot-rolled steel sheets after pickling are also shown in Table 2.

As shown in Table 2, the steel sheets Nos. 2 and 3, which were manufactured by employing the conditions satisfying $R\leqq 200$ and $R^2\times\sqrt{t}\leqq 100000$, exhibit considerably higher r-values than the steel sheet No. 1 which is a comparison sample. In addition, since, as shown in Table 1, the chemical composition of the steel slab used to manufacture the steel sheet No. 2 includes B, Sample No. 2 possesses excellent resistance to cold-working embrittlement (RSWE), as shown in Table 2.

It will be understood from these results that a hot-rolled steel sheet manufactured by employing conditions falling within their respective ranges according to the present invention possesses excellent deep-drawability and excellent resistance to cold-working embrittlement.

(Example 2)

Steel sheets Nos. 1 and 2, shown in Table 3, were obtained in the following manner. Steel slabs having the chemical compositions 501 and 501 shown in Table 1 were heated and soaked at 1150° C. Thereafter, the slabs were roughened, then subjected to final rolling. Table 3 shows the conditions adopted in these processes, i.e., the roughening delivery temperature (RDT), the finish delivery temperature (FDT), the rolling reduction during rolling within a temperature range lower than the Ar3 transformation point but not lower than 500° C., the coiling temperature (CT), whether any lubricant was used or not, the radius R (mm) of rolls on three downstream stands, and the values of $R^2\times\sqrt{t}$ determined by the radius R and the thickness t (mm) before the final rolling. The final thickness was 1.6 mm. After the finally rolled steel sheets were pickled, they were subjected to box annealing at 750° C. for 5 hours.

Properties of the hot-rolled steel sheets after annealing are also shown in Table 3. It will be understood from Table 3 that hot-rolled steel sheets manufactured by employing conditions falling within their respective ranges according to the present invention possess excellent deep-drawability.

(Example 3)

Steel sheets Nos. 1 to 4, shown in Table 4, were obtained in the following manner. Steel slabs having the chemical compositions 501, 501 and 501 shown in Table 1 were heated and soaked at 1150° C. Thereafter, the slabs were roughened, then subjected to final rolling. Table 4 shows the conditions adopted in these processes, i.e., the roughening delivery temperature (RDT), the finish delivery temperature (FDT), the coiling temperature (CT), whether any lubricant was used or not, the radius R (mm) of rolls on three downstream stands, and the values of $t/R^4$ determined by the radius R and the thickness t (mm) before the final rolling. The final thickness was 1.2 mm.

Properties of the hot-rolled steel sheets after pickling are also shown in Table 4. As shown in Table 4, the steel sheet No. 1, a comparison sample, which was manufactured employing the conditions of CT $<600°$ C. and (FDT)−(CT) $>100°$ C., exhibits a low r-value. The other samples manufactured employing conditions falling within their respective ranges according to the present invention exhibit excellent deep-drawability. It will also be understood from Table 4 that, if B is included in the chemical composition of the steel slab used, the resultant steel sheet possesses excellent resistance to cold-working embrittlement.

(Example 4)

Steel sheets Nos. 1 and 2, shown in Table 5, were obtained in the following manner. Steel slabs having the chemical compositions 501 and 501 shown in Table 1 were heated and soaked at 1150° C. Thereafter, the slabs were roughened, then subjected to final rolling. Table 5 shows the conditions adopted in these processes, i.e., the roughening delivery temperature (RDT), the finish delivery temperature (FDT), the coiling temperature (CT), whether any lubricant was used or not, the radius R (mm) of rolls on three downstream stands, and the values of $t/R^4$ determined by the radius R and the thickness t (mm) before the final rolling. The final thickness was 1.6 mm. After the finally rolled steel sheets were pickled, they were subjected to box annealing at 750° C. for 5 hours.

Properties of the hot-rolled steel sheets after annealing are also shown in Table 5. It will be understood from Table 5 that a hot-rolled steel sheet manufactured by employing conditions falling within their respective ranges according to the present invention possesses excellent deep-drawability.

(Example 5)

Steel sheets Nos. 1 to 3, shown in Tables 6 (1) and 6 (2), were obtained in the following manner. Steel slabs having the chemical compositions 501 and 501 shown in Table 1 were heated and soaked at 1150° C. Thereafter, the slabs were roughened, then subjected to final rolling. Tables 6 (1) and 6 (2) show the conditions adopted in these processes, i.e., the roughening delivery temperature (RDT), the finish entrance temperature (FET), the finish delivery temperature (FDT), the coiling temperature (CT), the radius R (mm) of rolls on three stands, the thickness t (mm) before the final rolling, and the coefficient of friction ($\mu$). The final thickness was 1.2 mm.

Properties of the hot-rolled steel sheets after pickling or after recrystallization annealing following pickling are shown in Table 6 (2). As shown in Table 6 (2), the steel sheet No. 3, a comparison sample, manufactured by employing a coefficient of friction ($\mu$) which does not satisfy the relationship of $\mu \leqq -0.2 \log (R/t) + 0.55$, exhibits a low r-value. The other samples manufactured employing conditions falling within their respective ranges according to the present invention exhibit higher levels of deep-drawability than the comparison sample.

(Example 6)

Steel sheets Nos. 1 to 4, shown in Table 7, were obtained in the following manner. Steel slabs having the chemical compositions 501 and 501 shown in Table 1 were heated and soaked at 1150° C. Thereafter, the slabs were roughened, then subjected to final rolling. Table 7 shows the conditions adopted in these processes, i.e., the roughening delivery temperature (RDT), the finish delivery temperature (FDT), the rolling reduction during rolling within a temperature range lower than the Ar3 transformation point but not lower than 500° C., whether any lubricant was used or not, the radius R (mm) of rolls on three downstream stands, and the values of $R^2 \times \sqrt{t}$ determined by the roll radius R and the thickness t (mm) before the final rolling. The final thickness was 1.6 mm.

In this example, the hot-rolled steel sheets were subjected the continuous processes of pickling, annealing and galvanizing. Some of the samples were not passed through an ordinary pickling line, and they were subjected to light pickling performed as a pretreatment in a galvanizing line, and the light pickling was continuously followed by the processes of annealing and galvanizing. In the light pickling, mechanical descaling was also performed. The annealing was conducted at 830° C. for 40 seconds.

Properties of the resultant galvanized steel sheets are shown in Table 7. The adhesion of the zinc plating was evaluated in the following manner. A piece of adhesive tape was attached to the plated surface of each steel sheet. The steel sheet was bent through 90 degrees, and was then returned to its initial position. Thereafter, the piece of adhesive tape was removed, and the amount of Zn peeled off together with the tape was measured utilizing fluorescent X-rays. It will be understood from the results shown in Table 7 that hot-rolled steel sheets manufactured by employing conditions falling within their respective ranges according to the present invention possess excellent plating adhesion and, simultaneously, possess a high level of deep-drawability. Sample No. 2, which was manufactured by employing a roughening delivery temperature (RDT) exceeding 950° C., shows a lower r-value than Sample No. 1 having the same chemical composition. It will also be understood from Table 7 that, if B is included in the chemical composition of the steel slab used, the resultant steel sheet exhibits excellent resistance to cold-working embrittlement.

(Example 7)

A steel sheet No. 1, shown in Tables 8 (1) and 8 (2), was obtained in the following manner. A steel slab having the chemical compositions 501 shown in Table 1 was roughened continuously from continuous casting. Thereafter, the slab was subjected to the final rolling (CC-DR). Tables 8 (1) and (2) show the conditions adopted in these processes, i.e., the roughening delivery temperature (RDT), the finish entrance temperature (FET), the finish delivery temperature (FDT), the coiling temperature (CT), the radius R (mm) of rolls, the thickness t (mm) before the final rolling, the coefficient of friction ($\mu$), and whether annealing was effected or not. Properties of the steel sheet after pickling are shown in Table 8 (2).

It will be understood from Tables 8 (1) and 8 (2) that a hot-rolled steel sheet manufactured employing conditions falling within their respective ranges according to the present invention possesses excellent deep-drawability.

Thus, according to the present invention, it is possible to manufacture hot-rolled steel sheet possessing excellent deep-drawability which is as high as that of cold-rolled steel sheet, and suffering from no cold-working embrittlement. Therefore, when the manufacture of hot-rolled steel sheet that adopts the method according to the present invention is compared with the conventional practice of manufacturing cold-rolled sheet, the adoption of the method of the present invention enables a great reduction in production costs. Further, according to the present invention, it is possible to manufacture galvanized steel sheet which is excellent in deep-drawability, while making it possible to omit the process of cold rolling or the processes of pickling and cold rolling, thereby enabling a great reduction in production costs.

TABLE 1

| STEEL TYPE | C | Si | Mn | P | S | Al | N | Ti | Nb | B | Sb | Ar3 (°C.) | X ($\times 10^{-4}$) |
|---|---|---|---|---|---|---|---|---|---|---|---|---|---|
| 1 | 0.001 | 0.02 | 0.14 | 0.009 | 0.012 | 0.052 | 0.002 | 0.043 | 0.022 | 0.0007 | — | 865 | 8.6 |
| 2 | 0.001 | 0.01 | 0.23 | 0.009 | 0.009 | 0.054 | 0.003 | 0.048 | 0.014 | — | — | 855 | 7.9 |
| 3 | 0.003 | 0.02 | 0.13 | 0.012 | 0.006 | 0.048 | 0.002 | 0.052 | 0.011 | 0.0004 | — | 865 | 7.3 |
| 4 | 0.003 | 0.01 | 0.23 | 0.013 | 0.009 | 0.068 | 0.002 | 0.065 | 0.013 | — | — | 860 | 10.2 |
| 5 | 0.004 | 0.02 | 0.11 | 0.012 | 0.005 | 0.051 | 0.002 | 0.062 | 0.008 | 0.0005 | — | 855 | 8.1 |
| 6 | 0.001 | 0.01 | 0.18 | 0.011 | 0.008 | 0.042 | 0.001 | 0.051 | 0.016 | 0.0008 | 0.008 | 865 | 10.5 |
| 7 | 0.001 | 0.02 | 0.22 | 0.013 | 0.010 | 0.039 | 0.001 | 0.042 | 0.014 | — | — | 855 | 8.4 |
| 8 | 0.002 | 0.02 | 0.21 | 0.011 | 0.002 | 0.036 | 0.001 | 0.048 | 0.012 | — | — | 860 | 8.4 |
| 9 | 0.003 | 0.02 | 0.11 | 0.012 | 0.009 | 0.040 | 0.002 | 0.062 | 0.008 | 0.0009 | — | 855 | 9.1 |

TABLE 1-continued

| STEEL TYPE | C | Si | Mn | P | S | Al | N | Ti | Nb | B | Sb | Ar3 (°C.) | X ($\times 10^{-4}$) |
|---|---|---|---|---|---|---|---|---|---|---|---|---|---|
| 10 | 0.003 | 0.02 | 0.16 | 0.012 | 0.008 | 0.042 | 0.002 | 0.050 | 0.009 | 0.0004 | — | 865 | 6.7 |

X: (Ti/48 + Nb/93) − 1.2 (C/12 + N/14)

TABLE 2

| No. | STEEL TYPE | HOT ROLLING CONDITIONS RDT (°C.) | REDUCTION (%) | FDT (°C.) | CT (°C.) | LUBRICANT | (FDT)-(CT) (°C.) |
|---|---|---|---|---|---|---|---|
| 1 | 1 | 900 | 95 | 710 | 690 | NOT USED | 20 |
| 2 | 1 | 910 | 95 | 700 | 680 | NOT USED | 20 |
| 3 | 2 | 890 | 95 | 690 | 680 | USED | 10 |

| No. | STEEL TYPE | HOT ROLLING CONDITIONS F5 R (mm) | F5 $R^2 \times \sqrt{t}$ | F6 R (mm) | F6 $R^2 \times \sqrt{t}$ | F7 R (mm) | F7 $R^2 \times \sqrt{t}$ | PROPERTIES El (%) | $\bar{r}$ | Δr | RSWE |
|---|---|---|---|---|---|---|---|---|---|---|---|
| 1 | 1 | 250 | 147000 | 250 | 114000 | 250 | 88000 | 48 | 1.0 | 0.3 | o* |
| 2 | 1 | 150 | 47000 | 150 | 38000 | 100 | 13000 | 51 | 1.7 | 0.2 | o |
| 3 | 2 | 150 | 70000 | 100 | 22000 | 75 | 9000 | 52 | 1.9 | 0.6 | x |

F: Rolling mill stand;
El: Elongation (%);
$\bar{r}$: Lankford value;
Δr: Anisotropy;
RSWE: Resistance to cold-working embrittlement;
*Comparison sample;
o: Excellent;
x: Poor

TABLE 3

| No. | STEEL TYPE | HOT ROLLING CONDITIONS RDT (°C.) | RE-DUC-TION (%) | FDT (°C.) | CT (°C.) | LU-BRI-CANT | F5 R (mm) | F5 $R^2 \times \sqrt{t}$ | F6 R (mm) | F6 $R^2 \times \sqrt{t}$ | F7 R (mm) | F7 $R^2 \times \sqrt{t}$ | PROPERTIES El (%) | $\bar{r}$ | Δr | RSWE |
|---|---|---|---|---|---|---|---|---|---|---|---|---|---|---|---|---|
| 1 | 1 | 890 | 95 | 720 | 620 | NOT USED | 150 | 54000 | 150 | 44000 | 100 | 16000 | 51 | 1.9 | 0.2 | o |
| 2 | 2 | 890 | 95 | 620 | 570 | NOT USED | 150 | 80000 | 100 | 25000 | 75 | 10000 | 51 | 1.8 | 0.6 | x |

TABLE 4

| No. | STEEL TYPE | HOT ROLLING CONDITIONS RDT (°C.) | FDT (°C.) | C T (°C.) | (FDT) − (CT) (°C.) | LUBRICANT | F5 R (mm) | F5 $t/R^4$ ($\times 10^{-10}$) |
|---|---|---|---|---|---|---|---|---|
| 1 | 3 | 930 | 720 | 580 | 140 | NOT USED | 200 | 34 |
| 2 | 3 | 910 | 710 | 690 | 20 | USED | 200 | 24 |
| 3 | 4 | 880 | 710 | 680 | 30 | NOT USED | 200 | 24 |
| 4 | 5 | 900 | 690 | 680 | 10 | NOT USED | 200 | 34 |

| No. | STEEL TYPE | HOT ROLLING CONDITIONS F6 R (mm) | F6 $t/R^4$ ($\times 10^{-10}$) | F7 R (mm) | F7 $t/R^4$ ($\times 10^{-10}$) | PROPERTIES $\bar{r}$ | El (%) | RSWE |
|---|---|---|---|---|---|---|---|---|
| 1 | 3 | 200 | 20 | 150 | 38 | 0.8 | 41 | x* |
| 2 | 3 | 150 | 40 | 150 | 32 | 1.9 | 51 | o |
| 3 | 4 | 150 | 49 | 150 | 32 | 2.0 | 50 | x |
| 4 | 5 | 200 | 20 | 150 | 38 | 1.9 | 50 | o |

TABLE 5

| No. | STEEL TYPE | HOT ROLLING CONDITIONS RDT (°C.) | FDT (°C.) | C T (°C.) | LUBRICANT | F5 R (mm) | F5 $t/R^4$ ($\times 10^{-10}$) | F6 R (mm) | F6 $t/R^4$ ($\times 10^{-10}$) | F7 R (mm) | F7 $t/R^4$ ($\times 10^{-10}$) | PROPER-TIES $\bar{r}$ | El (%) |
|---|---|---|---|---|---|---|---|---|---|---|---|---|---|
| 1 | 4 | 910 | 720 | 580 | NOT USED | 200 | 21 | 200 | 13 | 150 | 30 | 1.8 | 51 |
| 2 | 5 | 900 | 610 | 510 | NOT USED | 200 | 45 | 300 | 5 | 300 | 3 | 1.0 | 50* |

TABLE 6 (1)

| No. | STEEL TYPE | HOT ROLLING CONDITIONS RDT (°C.) | FET (°C.) | FDT (°C.) | C T (°C.) | (FDT) − (CT) (°C.) | F5 R (mm) | t (mm) | Z | μ | F6 R (mm) | t (mm) | Z | μ |
|---|---|---|---|---|---|---|---|---|---|---|---|---|---|---|
| 1 | 6 | 890 | 700 | 650 | 540 | 110 | 200 | 4.8 | 0.23 | 0.18 | 150 | 3.1 | 0.21 | 0.17 |
| 2 | 7 | 880 | 780 | 720 | 690 | 30 | 200 | 4.8 | 0.23 | 0.18 | 150 | 3.1 | 0.21 | 0.16 |
| 3 | 7 | 890 | 800 | 700 | 680 | 20 | 300 | 4.8 | 0.19 | 0.20 | 300 | 3.1 | 0.15 | 0.18 |

$Z = -0.2 \log (R/t) + 0.55$
μ Coefficient of friction

TABLE 6 (2)

| No. | STEEL TYPE | HOT ROLLING CONDITIONS F7 R (mm) | t (mm) | Z | μ | ANNEALING | PROPERTIES $\bar{r}$ | El (%) |
|---|---|---|---|---|---|---|---|---|
| 1 | 6 | 150 | 2.0 | 0.17 | 0.16 | 720° C., 5 HRS | 2.1 | 52 |
| 2 | 7 | 150 | 2.0 | 0.17 | 0.16 | NOT EFFECTED | 2.0 | 52 |
| 3 | 7 | 300 | 2.0 | 0.11 | 0.16 | NOT EFFECTED | 1.1 | 49* |

TABLE 7

| No. | STEEL TYPE | HOT ROLLING CONDITIONS RDT (°C.) | REDUCTION (%) | FDT (°C.) | LUBRICANT | PICKLING, ANNEALING & PLATING |
|---|---|---|---|---|---|---|
| 1 | 8 | 900 | 95 | 630 | NOT USED | CONTINUOUS |
| 2 | 8 | 980 | 90 | 680 | NOT USED | CONTINUOUS |
| 3 | 9 | 930 | 95 | 700 | USED | CONTINUOUS |
| 4 | 9 | 890 | 95 | 670 | NOT USED | CONTINUOUS |

| No. | STEEL TYPE | HOT ROLLING CONDITIONS F5 R (mm) | $R^2 \times \sqrt{t}$ | F6 R (mm) | $R^2 \times \sqrt{t}$ | F7 R (mm) | $R^2 \times \sqrt{t}$ | PROPERTIES El (%) | $\bar{r}$ | Δr | RSWE | PLATING TYPE | PLATING ADHESION |
|---|---|---|---|---|---|---|---|---|---|---|---|---|---|
| 1 | 8 | 100 | 22000 | 100 | 18000 | 75 | 8000 | 51 | 1.8 | 0.5 | x | ALLOY | o |
| 2 | 8 | 150 | 49000 | 150 | 41000 | 150 | 32000 | 50 | 1.6 | 0.5 | x | NON-ALLOY | o |
| 3 | 9 | 150 | 54000 | 150 | 45000 | 100 | 15000 | 52 | 1.9 | 0.2 | o | ALLOY | o |
| 4 | 9 | 250 | 115000 | 150 | 35000 | 150 | 29000 | 50 | 1.7 | 0.2 | o | NON-ALLOY | o |

TABLE 8 (1)

| No. | STEEL TYPE | HOT ROLLING CONDITIONS RDT (°C.) | FET (°C.) | FDT (°C.) | C T (°C.) | (FDT) − (CT) (°C.) | F5 R (mm) | t (mm) | Z | μ | F6 R (mm) | t (mm) | Z | μ |
|---|---|---|---|---|---|---|---|---|---|---|---|---|---|---|
| 1 | 10 | 890 | 770 | 710 | 680 | 30 | 150 | 4.8 | 0.25 | 0.18 | 150 | 3.1 | 0.21 | 0.16 |

TABLE 8 (2)

| No. | STEEL TYPE | HOT ROLLING CONDITIONS F7 R (mm) | t (mm) | Z | μ | ANNEALING | PROPERTIES $\bar{r}$ | El (%) |
|---|---|---|---|---|---|---|---|---|
| 1 | 10 | 150 | 2.0 | 0.17 | 0.16 | NOT EFFECTED | 1.8 | 52 |

What is claimed is:

1. A method of manufacturing a steel sheet having excellent deep-drawability, comprising the step of:

rolling a steel blank into a steel sheet having a predetermined thickness, said steel containing C: not more than 0.008 wt %, Si: not more than 0.5 wt %, Mn: not more than 1.0 wt %, P: not more than 0.15 wt %, S: not more than 0.02 wt %, Al: 0.010 to 0.10 wt %, N: not more than 0.008 wt %, and at least one element selected from the group consisting of Ti and Nb which is contained in an amount satisfying the relationship of $1.2\ (C/12 + N/14) \leqq (Ti/48 + Nb/93)$, said step including at least one pass in which rolling is conducted within a temperature range that is lower than the Ar3 transformation point but is not lower than 500° C., in such a manner that the roll radius R (mm) and the blank thickness t (mm) before rolling by rolls satisfy the relationships of $R \leqq 200$ and $R^2 \times 100000$, and the total rolling reduction at temperatures lower than the Ar3 transformation point is not lower than 60%.

2. A method of manufacturing a steel sheet according to claim 1; wherein the rolling is effected by a rolling mill having a plurality of stands supporting a plurality of rolls, the radius R (mm) of those rolls positioned in downstream stands of the rolling mill satisfying the relationship of $R \leqq 200$.

3. A method of manufacturing a steel sheet according to claim 1, operating within a temperature range lower than the Ar3 transformation point but not lower than 500° C., wherein the roll radius R (mm) and the blank thickness t (mm) before rolling satisfy the relationship of $t/R^4 \geqq 6\times10^{-10}$.

4. A method of manufacturing a steel sheet according to claim 1, operating within a temperature range lower than the Ar3 transformation point but not lower than 500° C., wherein the roll radius R (mm), the blank thickness t (mm) before rolling by rolls, and the coefficient of friction $\mu$ therebetween Satisfy the relationship of $\mu \leqq -0.2 \log(R/t) + 0.55$.

5. A method of manufacturing a steel sheet according to claim ;1, wherein said steel further contains B: 0.0001 to 0.0020 wt %.

6. A method of manufacturing a steel sheet according to claim 1, wherein said steel further contains Sb: 0.001 to 0.020 wt %.

7. A method of manufacturing a steel sheet according to claim 1, further comprising the step of, before effecting the rolling within a temperature range lower than the Ar3 transformation point, effecting rolling which terminates within a temperature range between 950° C. and the Ar3 transformation point both inclusive, the rolling within a temperature range lower than the Ar3 transformation point being continuously effected thereafter.

8. A method of manufacturing a steel sheet according to claim 1, wherein, during the final rolling, coiling is effected in the condition where the finish delivery temperature (FDT) and the coiling temperature (CT) satisfy the relationships of (FDT)−(CT)≦100° C. and (CT) ≧600° C.

9. A method of manufacturing a steel sheet according to claim 1, further comprising the step of, after the final rolling, effecting recrystallization annealing.

10. A method of manufacturing a steel sheet according to claim 1, further comprising the step of, after the final rolling, effecting pickling, annealing at temperatures ranging from 700° to 900° C. for 1 second to 20 minutes, and galvanizing.

11. A method of manufacturing a steel sheet according to claim 10 wherein the pickling, the annealing, and the galvanizing are continuously effected.

12. A method of manufacturing a steel sheet according to claim 2, operating within a temperature range lower than the Ar3 transformation point but not lower than 500° C., wherein the roll radius R (mm) and the blank thickness t (mm) before rolling satisfy the relationship of $t/R^4 \geqq 6\times10^{-10}$.

13. A method of manufacturing a steel sheet according to claim 2, operating within a temperature range lower than the Ar3 transformation point but not lower than 500° C., wherein the roll radius R (mm), the blank thickness t (mm) before rolling by rolls, and the coefficient of friction $\mu$ therebetween satisfy the relationship of $\mu \leqq -0.2 \log(R/t) + 0.55$.

14. A method of manufacturing a steel sheet according to claim 2, wherein, during the final rolling, coiling is effected in the condition where the finish delivery temperature (FDT) and the coiling temperature (CT) satisfy the relationships of (FDT)−(CT) ≦100° C. and (CT)≧600° C.

15. A method of manufacturing a steel sheet according to claim 3, wherein, during the final rolling, coiling is effected in the condition where the finish delivery temperature (FDT) and the coiling temperature (CT) satisfy the relationships of (FDT)−(CT) 100° C. and (CT)≧600° C.

16. A method of manufacturing a steel sheet according to claim 4, wherein, during the final rolling, coiling is effected in the condition where the finish delivery temperature (FDT) and the coiling temperature (CT) satisfy the relationships of (FDT)−(CT) ≦100° C. and (CT)≧600° C.

17. A method of manufacturing a steel sheet according to claim 5, wherein, during the final rolling, coiling is effected in the condition where the finish delivery temperature (FDT) and the coiling temperature (CT) satisfy the relationships of (FDT)−(CT) 100° C. and (CT)≧600° C.

18. A method of manufacturing a steel sheet according to claim 6, wherein, during the final rolling, coiling is effected in the condition where the finish delivery temperature (FDT) and the coiling temperature (CT) satisfy the relationships of (FDT)−(CT) ≦100° C. and (CT)≧600° C.

19. A method of manufacturing a steel sheet according to claim 7, wherein, during the final rolling, coiling is effected in the conditions where the finish delivery temperature (FDT) and the coiling temperature (CT) satisfy the relationships of (FDT)−(CT) ≦100° C. and (CT)≧600° C.

20. A method of manufacturing a steel sheet according to claim 2, further comprising the step of, after the final rolling, effecting recrystallization annealing.

* * * * *